US007690345B2

(12) United States Patent
Vichinsky

(10) Patent No.: US 7,690,345 B2
(45) Date of Patent: Apr. 6, 2010

(54) ENGINE INTAKE MANIFOLD SYSTEM

(75) Inventor: Kevin Vichinsky, Portage, MI (US)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 11/492,075

(22) Filed: Jul. 25, 2006

(65) Prior Publication Data

US 2007/0175442 A1 Aug. 2, 2007

Related U.S. Application Data

(60) Provisional application No. 60/702,301, filed on Jul. 26, 2005.

(51) Int. Cl.
*F02M 35/10* (2006.01)

(52) U.S. Cl. ..... 123/184.21

(58) Field of Classification Search ..... 123/41.08, 123/41.1, 552, 41.14; 62/503, 512; 60/710; 137/481

See application file for complete search history.

(56) References Cited

U.S. PATENT DOCUMENTS

| | | | | | |
|---|---|---|---|---|---|
| 1,306,000 | A * | 6/1919 | Fulton et al. | ..... | 123/41.1 |
| 1,694,727 | A * | 12/1928 | Allen | ..... | 132/299 |
| 1,694,751 | A * | 12/1928 | Nutt | ..... | 123/41.08 |
| 2,763,252 | A * | 9/1956 | Dolza et al. | ..... | 123/552 |
| 3,559,727 | A * | 2/1971 | Hill et al. | ..... | 165/11.1 |
| 3,698,207 | A * | 10/1972 | Melnyk | ..... | 62/503 |
| 6,138,618 | A * | 10/2000 | Genster | ..... | 123/41.14 |
| 6,615,609 | B2 * | 9/2003 | Kawasaki et al. | ..... | 62/503 |

* cited by examiner

*Primary Examiner*—Stephen K Cronin
*Assistant Examiner*—Keith Coleman

(57) ABSTRACT

An intake manifold system for an international combustion engine includes an engine intake manifold having a valve; and an actuator connected to the valve to control valve opening. The actuator is connected to a pressurized coolant reservoir of the engine to allow the use of the pressurized fluid of the coolant reservoir to operate the actuator.

12 Claims, 1 Drawing Sheet

ENGINE INTAKE MANIFOLD SYSTEM

CROSS REFERENCE TO RELATED APPLICATIONS

This application claims priority from U.S. Provisional Patent Application No. 60/702,301, filed Jul. 26, 2005.

FIELD OF THE INVENTION

This invention relates to an intake manifold system for an internal combustion engine.

BACKGROUND OF THE INVENTION

The performance of an internal combustion engine can be optimized by adjusting the characteristics of its intake manifold as a function of the engine's operating condition. The characteristics of an intake manifold, such as its geometry, can be adjusted with one or more valves, such as charge motion control valves and resonance valves. Thus the performance of an international combustion engine can be optimized by controlling the valves of the engine's intake manifold.

Currently, the valves of an intake manifold are actuated with electric actuators or vacuum actuators. Each of the two types of actuators has several disadvantages. For example, an electric actuator is relatively expansive and difficult to accommodate in a tightly-packed engine compartment of a vehicle. A vacuum actuator requires a vacuum tank, which is also difficult to accommodate in an engine compartment.

SUMMARY OF THE INVENTION

An engine intake manifold system of the present invention overcomes some of the disadvantages associated with the electric and vacuum actuators. In accordance with one aspect of the present invention, an engine intake manifold system includes an intake manifold having a valve, and an actuator connected to the valve to control valve opening. The actuator is also connected to a pressurized coolant reservoir of the engine to allow the use of the pressurized fluid in the coolant reservoir to operate the actuator.

An intake manifold system of the present invention is relatively inexpensive when compared with an electric actuator, and easier to accommodate when compared with a vacuum actuator with a vacuum tank. The intake manifold system is also simple because it uses an existing power source—the pressurized coolant reservoir of the engine.

In a preferred embodiment, the actuator includes a housing, a diaphragm that sealingly divides the housing into first and second chambers, a rod that is connected to the diaphragm and extends to the exterior of the housing through the first chamber, and a spring urging the diaphragm towards the second chamber. The second chamber may be connected to the pressurized coolant reservoir to allow the use of pressurized fluid of the coolant reservoir to push the diaphragm towards the first chamber against the spring. The rod is connected to the valve to use the movement of the rod to control valve opening.

The intake manifold system may also include a control valve for controlling the pressure in the actuator to adjust the opening of the intake manifold valve. The control valve preferably is disposed in a flow path between the actuator and the pressurized coolant reservoir. In a preferred embodiment, the control valve may be used to control the pressure in the actuator's second chamber to adjust the opening of the intake manifold valve.

The intake manifold system may further include a pressure tank disposed between the actuator and the pressurized coolant reservoir, as well as a valve disposed between the pressure tank and the pressurized coolant reservoir. This valve closes or opens the flow path between the pressure tank and the pressurized coolant reservoir. With this arrangement, the valve opening can be adjusted to maintain a constant pressure in the pressure tank even when the pressure in the coolant reservoir fluctuates. Additionally, the pressure in the pressure tank can be maintained by closing the valve even when the engine is cold and the pressure in the coolant reservoir is low. An accumulator may be connected to the pressure tank to assist in the maintenance of tank pressure.

In a preferred embodiment, the pressure tank and the pressurized coolant reservoir are integrally formed. For example, they may be integrally formed by means of injection molding.

In accordance with another aspect of the invention, an engine intake manifold system includes the pressurized coolant reservoir of the engine, as well as the components described above. In other words, the pressurized coolant reservoir of the engine may be considered as a component of the intake manifold system, not a component to which the intake manifold system is connected.

Other objects, advantages and novel features of the present invention will become apparent from the following detailed description of the invention when considered in conjunction with the accompanying drawings.

DESCRIPTION OF PREFERRED EMBODIMENTS

Figure 1:
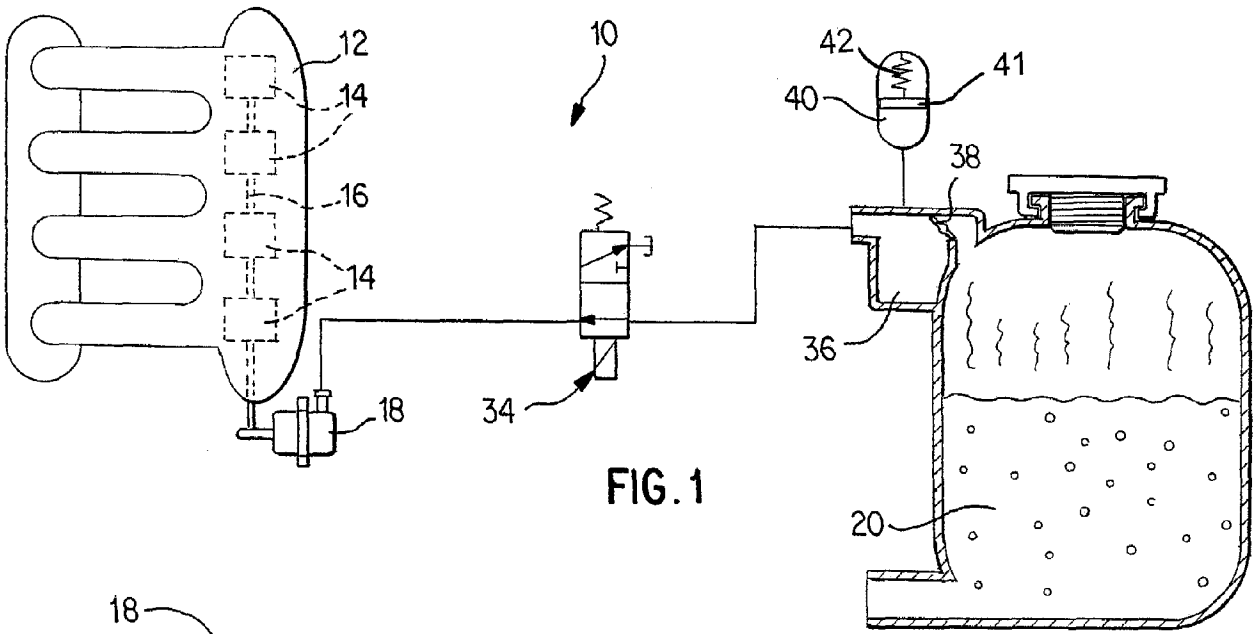
FIG. 1 illustrates an engine intake manifold system of the present invention.

FIG. 1 illustrates an engine intake manifold system 10 of the present invention. The engine intake manifold system 10 includes an intake manifold 12 that has a set of four valves 14. The valves 14 are fixed to, and can be rotated by, a valve shaft 16. The intake manifold system 10 also includes an actuator 18, which is connected to the valve shaft 16 to rotate the shaft 16 and valves 14 to open or close valve openings (not shown). The actuator 18 is connected to a pressurized coolant reservoir 20 of the engine so that the pressurized fluid of the coolant reservoir 20 can be used to operate the actuator 18.

The intake manifold of the present invention may be an intake manifold of any type. For example, it may be an intake manifold for a V-8 engine or for a straight-4 engine. The intake manifold may also include more than one set of valves, and each additional set of valves can be operated by a separate actuator powered by the pressurized coolant reservoir. The valves can be, for example, barrel valves, charge motion control valves and/or resonance valves.

Figure 2:
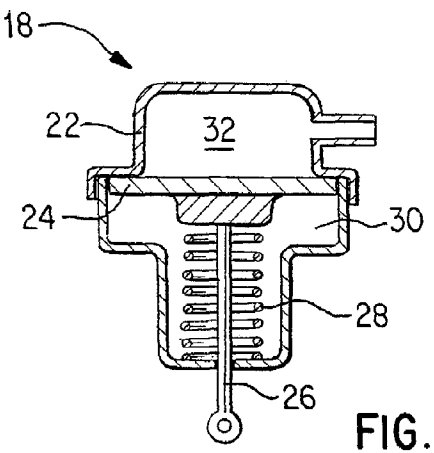
FIG. 2 illustrates an actuator of the embodiment shown in FIG. 1.

The actuator of the present invention may be any actuator that can use pressurized fluid to drive a valve shaft. FIG. 2 illustrates an example of the actuator. In this example, the actuator 18 includes a housing 22, a diaphragm 24, a rod 26, and a spring 28. The diaphragm 24 is sealingly attached to the housing's interior and divides the housing 22 into first and second chambers 30, 32. The rod 26 is connected to, and can move with, the diaphragm 24, and it extends to the exterior of the housing 22 through the first chamber 30. The spring 28 is disposed in the first chamber 30 and urges the diaphragm 24 towards the second chamber 32. The second chamber 32 is connected to the pressurized coolant reservoir 20 and receives pressurized fluid to push the diaphragm 24 towards the first chamber 30 against the spring 28. The rod 26 is connected to the valve shaft 16 via a mechanism (not shown) such as a crank mechanism to allow the linear movement of the rod 26 to be translated into a rotational movement of the valve shaft 16.

In operation, as the pressure in the second chamber 32 increases, the diaphragm 24 and rod 26 is pushed towards to the first chamber 30, and the spring 28 is further compressed. As the pressure in the second chamber 32 decreases, the diaphragm 24 and rod 26 is pushed towards to the second chamber 32 by the spring 28. Thus, the pressure increase and decrease in the second chamber 32 generates a linear movement of the rod 26, which in turn produces a rotational movement of the valve shaft 16.

The pressurized coolant reservoir 20 is known in the art and therefore will not be discussed in detail here. It just needs to be mentioned that when the engine is sufficiently warmed up, the reservoir 20 has a chamber that is filled with pressurized fluid (i.e., coolant and air). The pressurized fluid can be used as a power source for the actuator of the present invention.

As shown in FIG. 1, the engine intake manifold system 10 of the present invention may also include a control valve 34 that is disposed in a flow path between the second chamber 32 of the actuator 16 and the pressurized coolant reservoir 20. This control valve 34 can be used to control the pressure in the second chamber 32 and ultimately the position of the valves 14. Such a control valve is well known in the art and will not be discussed in detail here.

To simplify the operation of the control valve 34, it is desirable to provide the control valve 34 with a relatively constant supply pressure. The pressure in the pressurized coolant reservoir 20, however, varies with the engine operating condition. Thus it is desirable to provide an arrangement that maintains a relatively constant supply pressure to the control valve 34 in spite of the pressure variations in the pressurized coolant reservoir 20. In the embodiment shown in FIG. 1, the arrangement includes a pressure tank 36 disposed between the control valve 34 and the pressurized coolant reservoir 20, and a valve 38 disposed in the flow path between the pressure tank 36 and the pressurized coolant reservoir 20.

This valve 38 can be used to maintain a relatively constant pressure in the pressure tank 36. For example, if the pressure in the pressure tank 36 is higher than the desired pressure, the valve 38 reduces its opening to reduce the flow of pressurized fluid from the pressurized coolant reservoir 20 to the pressure tank 36, thereby decreasing the pressure in the pressure tank 36. On the other hand, if the pressure in the pressure tank 36 is lower than the desired pressure, the valve 38 enlarges its opening to increase the flow of pressurized fluid into the pressure tank 36, thereby increasing the pressure in the pressure tank 36. Additionally, this arrangement can be used to maintain a pressure in the pressure tank 36 when the engine is shut off so that during an engine start-up when the pressure in the coolant reservoir 20 is low, the pressure in the pressure tank 36 can be used to control the intake manifold valve 14.

The arrangement may include an accumulator 40 connected to the pressure tank 36. As can be seen from FIG. 1, accumulator 40 comprises a piston 41 supported on a spring 42. The accumulator 40 can increase the pressure tank's ability to maintain the desired pressure.

The pressure tank 36 and the pressurized coolant reservoir 20 can be integrally formed, as shown in FIG. 1. For example, the pressure tank 36 and the pressurized coolant reservoir 20 can be formed together using injection molding.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. An intake manifold system for an internal combustion engine having a pressurized coolant reservoir, the intake manifold system comprising:

an engine intake manifold having a valve for varying a geometry thereof;

an actuator with a diaphragm connected to the valve to control valve opening, wherein the actuator is connected to the pressurized coolant reservoir to allow the use of pressurized fluid of the coolant reservoir to apply a force generated by the pressurized fluid displacing the diaphragm, independently of fluid temperature, for operating the actuator;

a pressure tank disposed between the actuator and the pressurized coolant reservoir; and an accumulator connected to the pressure tank, said accumulator comprising a piston supported on a spring.

2. The intake manifold system of claim 1, wherein the actuator includes a housing, wherein the diaphragm sealingly divides the housing into first and second chambers, and a rod that is connected to the diaphragm extends to the exterior of the housing through the first chamber, and wherein a spring urging the diaphragm towards the second chamber.

3. The intake manifold system of claim 2, wherein the second chamber is connected to the pressurized coolant reservoir to allow the use of pressurized fluid of the coolant reservoir to push the diaphragm towards the first chamber against the spring.

4. The intake manifold system of claim 3, wherein the rod is connected to the valve to allow the movement of the rod to control valve opening.

5. The intake manifold system of claim 3, further comprising a control valve disposed in a flow path between the second chamber of the actuator and the pressurized coolant reservoir to control the pressure in the second chamber.

6. The intake manifold system of claim 1, further comprising a control valve disposed in a flow path between the actuator and the pressurized coolant reservoir to control actuator pressure.

7. The intake manifold system of claim 1, further comprising a valve disposed between the pressure tank and the pressurized coolant reservoir, wherein the valve closes or opens a flow path between the pressure tank and the pressurized coolant reservoir.

8. The intake manifold system of claim 1, wherein the pressure tank and the pressurized coolant reservoir are integrally formed.

9. An intake manifold system for an internal combustion engine, the intake manifold system comprising:

an engine intake manifold having a valve for varying a geometry thereof;

an actuator with a diaphragm connected to the valve to control valve opening;

a pressurized coolant reservoir of the engine, wherein the actuator is connected to the pressurized coolant reservoir to allow the use of pressurized fluid of the coolant reservoir to apply a force generated by the pressurized fluid displacing the diaphragm, independently of fluid temperature, for operating the actuator;

a pressure tank disposed between the actuator and the pressurized coolant reservoir; and an accumulator connected to the pressure tank, said accumulator comprising a piston supported on a spring.

10. The intake manifold system of claim 9, further comprising a control valve disposed in a flow path between the actuator and the pressurized coolant reservoir to control actuator pressure.

11. The intake manifold system of claim 9, further comprising a valve disposed between the pressure tank and the pressurized coolant reservoir, wherein the valve closes or opens a flow path between the pressure tank and the pressurized coolant reservoir.

12. The intake manifold system of claim 9, wherein the pressure tank and the pressurized coolant reservoir are integrally formed.

* * * * *